US005689206A

United States Patent [19]

Schaller

[11] Patent Number: 5,689,206

[45] Date of Patent: Nov. 18, 1997

[54] SC-INTEGRATOR WITH SWITCHABLE POLARITY

[75] Inventor: Michel Schaller, Baar, Switzerland

[73] Assignee: Landis & Gyr Technology Innovation AG, Zug, Switzerland

[21] Appl. No.: 639,687

[22] Filed: Apr. 29, 1996

[30] Foreign Application Priority Data

Jun. 7, 1995 [CH] Switzerland ..... 1662/95

[51] Int. Cl.[6] ..... G06G 7/64

[52] U.S. Cl. ..... 327/337; 327/336

[58] Field of Search ..... 327/334, 335, 327/336, 337, 339, 345

[56] References Cited

U.S. PATENT DOCUMENTS

| | | | |
|---|---|---|---|
| 4,496,858 | 1/1985 | Smith | 327/337 |
| 5,329,191 | 7/1994 | Korhonen et al. | 327/334 |
| 5,331,222 | 7/1994 | Lin et al. | 327/337 |

FOREIGN PATENT DOCUMENTS

| | | | |
|---|---|---|---|
| 0 607 712 A1 | 7/1994 | European Pat. Off. | G06G 7/186 |
| WO A 89 02192 | 3/1989 | WIPO | H03K 17/00 |

*Primary Examiner*—Timothy P. Callahan
*Assistant Examiner*—Jeffrey Zweizig
*Attorney, Agent, or Firm*—Meltzer, Lippe, Goldstein et al.

[57] ABSTRACT

An SC-integrator comprises an amplifier connected to a circuit network, which includes an integrating capacitor and a storage capacitor. The storage capacitor is connected via a first switch to the output of the amplifier and via a second switch directly to one side of a switching circuit capacitor, which is also connected by means of third and fourth switches to ground and the inverting input of the amplifier, respectively. The other side of the switching circuit capacitor is connected by means of a fifth switch to an input voltage Vin, via a sixth switch to ground, and by means of a seventh switch to a reference voltage Vref. The SC integrator uses a storage capacitor of relatively low capacitance value, since the storage capacitor is connected in parallel with the switching circuit capacitor when effecting a reversal of the voltage polarity across the integrating capacitor.

6 Claims, 2 Drawing Sheets

SC-INTEGRATOR WITH SWITCHABLE POLARITY

BACKGROUND OF THE INVENTION

1. Field of the Invention

The invention relates generally to SC-integrators with switchable polarity. An SC-integrator (Switched Capacity integrator), as is known, is an integrator with switched capacities. The invention may be particularly applied to an SC-integrator with reversible polarity, said integrator comprising at least a first switch arrangement and an integration arrangement; wherein said integration arrangement comprises an amplifier having an inverting input and a non-inverting output, and at least a first circuit network to which said amplifier is connected, said first circuit network comprising an integration capacitor, a storage capacitor having first and second terminals, and first and second switches, said non-inverting output of said amplifier being connected via said integration capacitor to said inverting input of said amplifier, said first terminal of said storage capacitor being connectable to ground and said second terminal of said storage capacitor being connected on the one hand to said non-inverting output of said amplifier via said first switch on the other hand to said first switch arrangement via said second switch; and wherein said first switch arrangement comprises a circuit capacitor having first and second terminals, and third, fourth, fifth, sixth and seventh switches, said first terminal of said circuit capacitor being connectable to ground via said third switch and connected via said fourth switch said inverting input of said amplifier, said second terminal of said circuit capacitor being connectable via said fifth switch to an input voltage Vin and via said sixth switch to a further voltage potential Vm, and said first switch arrangement being connectable via said seventh switch to a reference voltage Vref.

An SC-integrator of that kind is preferably used in sigma-delta-modulators which for example are part of analog/digital converters which are used in electricity meters in order to convert analog measurement signals such as for example a mains voltage and an associated electrical current or the product thereof such as for example an electric power associated with the respective current, into digital values.

2. Description of the Prior Art

An SC-integrator of the kind set forth in the opening part of this specification is known from EP 0 607 712 A1 (see FIG. 5 therein with associated description) and is shown in FIG. 1. For polarity reversal of an integration voltage stored in the integrator, it requires a storage capacitor whose capacitance value is relatively great, namely twice as great as that of an integration capacitor contained in the integrator.

SUMMARY OF THE INVENTION

An object of the present invention is so to improve the known SC-integrator that, while retaining the advantages thereof, it requires a storage capacitor whose capacitance value is significantly lower and it can thus be produced in a compact configuration and less expensively in an integrated circuit, for example by means of CMOS-technology.

In accordance with the invention the specified object is attained by an SC-integrator with reversible polarity, said integrator comprising at least a first switch arrangement and an integration arrangement; wherein said integration arrangement comprises an amplifier having an inverting input and a non-inverting output, and at least a first circuit network to which said amplifier is connected, said first circuit network comprising an integration capacitor, a storage capacitor having first and second terminals, and first and second switches, said non-inverting output of said amplifier being connected via said integration capacitor to said inverting input of said amplifier, said first terminal of said storage capacitor being connectable to ground and said second terminal of said storage capacitor being connected on the one hand to said non-inverting output of said amplifier via said first switch on the other hand to said first switch arrangement via said second switch; wherein said first arrangement comprises a circuit capacitor having first and second terminals, and third, fourth, fifth, sixth and seventh switches, said first terminal of said circuit capacitor being connectable to ground via said third switch and connected via said fourth switch said inverting input of said amplifier, said second terminal of said circuit capacitor being connectable via said fifth switch to an input voltage Vin and via said sixth switch to a further voltage potential Vm, and said first switch arrangement being connectable via said seventh switch to a reference voltage Vref; and wherein said second terminal of said storage capacitor is directly connected to said first terminal of said circuit capacitor via said second switch.

Advantageous embodiments of the invention are set forth in the appendant claims.

BRIEF DESCRIPTION OF THE DRAWINGS

The above and other objects, features and advantages of the invention will be apparent from the following detailed description of illustrative embodiments which is to be read in connection with the accompanying drawings in which.

DESCRIPTION OF THE PREFERRED EMBODIMENTS

Figure 1:
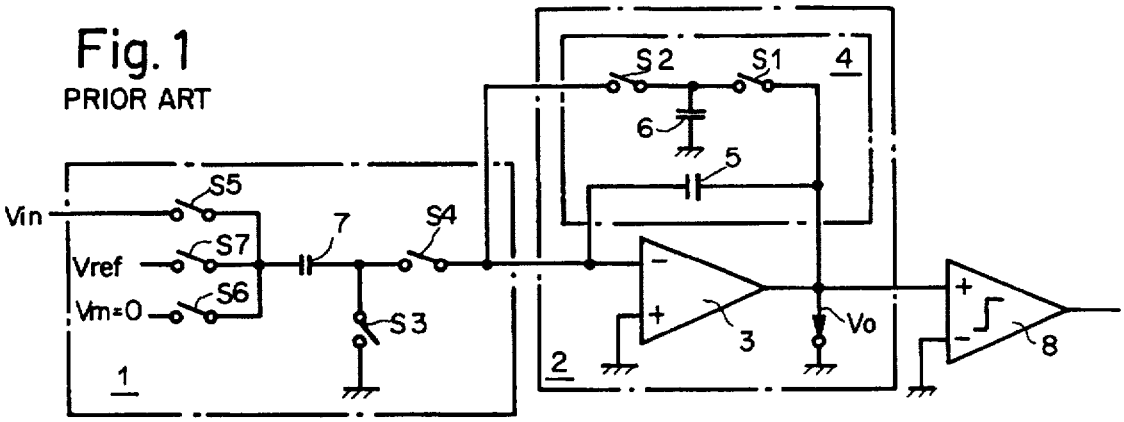
Fig. 1 PRIOR ART
FIG. 1 shows a circuit diagram of the known SC-integrator.

The known SC-integrator which is shown in FIG. 1 and which is constructed by means of switched capacities is provided with at least one switch arrangement 1 and an integration arrangement 2 which includes an amplifier 3 which is wired to at least one circuit network 4 by which a non-inverting output of the amplifier 3 is connected by way of an integration capacitor 5 to an inverting input of the amplifier 3 and in which a first terminal of a storage capacitor 6 is connected to ground, the second terminal thereof being connected on the one hand by way of a first switch S1 to the non-inverting output of the amplifier 3 and on the other hand by way of a second switch S2 to the switch arrangement 1. The latter in turn includes a circuit capacitor 7 whose first terminal is connected by means of a third and a fourth switch S3 and S4 to ground and to the inverting input of the amplifier 3 respectively, while its second terminal is connected by means of a fifth switch S5 to the input voltage Vin and by means of a sixth switch S6 to a further voltage potential Vm which in the known SC-integrator is equal to the ground potential. In addition, in that case, the switch arrangement 1 involves a connection from the second terminal of the circuit capacitor 7 by way of a seventh switch S7 to a reference voltage Vref. The capacitance value Cs of the storage capacitor 6 must be twice as great in the known integrator as the capacitance value Ci of the integration capacitor 5. The amplifier 3 is preferably an operational amplifier whose non-inverting input is at ground. Its non-inverting output is connected to a non-inverting input of a comparator 8 whose inverting input is at ground. Whenever an output voltage Vo of the amplifier 3 exceeds a value zero a logic value "1" appears at the output of the comparator 8, and that inverts the polarity of the reference voltage Vref by way of a control circuit (not shown) and the switches, so that the output voltage Vo decreases again and the logic value "1" at the output of the comparator 8 disappears again as soon as the output voltage Vo Falls below the value zero.

In the SC-integrator, integration of the algebraic sum Vin+Vref of the input voltage Vin and the reference voltage Vref which can both be both positive and also negative is effected in each case so that a total of four combinations +/+, −/−, +/− and −/+ are possible. In that respect, in succession in respect of time, during a sampling period of the integrator the input voltage +Vin or −Vin respectively are integrated and during another sampling period the reference voltage +Vref or −Vref respectively are integrated. If the two switches S5 and S4 are closed the amplifier 3 which in this case is connected as an inverting amplifier operates as an inverting integrator and then, when the switches S1 and S2 are open, its output voltage Vo is the integrated -Vin voltage. Integration of the +Vin voltage in turn takes place in two phases. In a first one of those phases the circuit capacitor 7 is charged during a sampling period with the input voltage Vin by way of the closed switches S5 and S3, which has no influence on the amplifier 3 as the switch S4 is not closed. In addition the switches S6 and S7 are open during that phase. In a subsequent phase the two switches S5 and S3 are open and the two switches S4 and S6 are closed, which has the result that on the one hand the polarity of the voltage Vin across the circuit capacitor 7 is inverted and on the other hand that inverted voltage is inverted again in the amplifier 3 which is operating as an inverting integrator, so that a non-inverted integration voltage appears at the output of the amplifier 3. The same thing also occurs during further sampling periods with the reference voltage Vref, with the difference that the switch S7 is actuated instead of the switch S5. If the polarity of signal processing is changed, the output voltage Vo of the integrator, at the moment of switching over, has a wrong sign which must therefore be inverted after the switching-over operation, if integration is to be effected correctly. That is effected, again in two phases, by means of the storage capacitor 6 and the two switches S1 and S2. In a first one of those phases the output voltage Vo of the amplifier B which at the same time is the voltage across the integration capacitor 5 charges the storage capacitor 6 with a charge Cs·Vo, when the switch S2 is open by way of the closed switch S1, which charge is then changed over into the integration capacitor Ci in the next phase with reversed polarity with the switch S1 open, by way of the closed switch S2, so that the charge thereof is in total equal to $Ci \cdot Vo - Cs \cdot Vo = Vo(Ci - 2Ci) = -Vo \cdot Ci$, when $Cs = 2Ci$. Therefore, as intended, the voltage across the integration capacitor 5 has changed its polarity and has thus altered its value from +Vo to −Vo. All this is known per se in relation to the known integrator and is described in detail in EP 0 607 712 A1. The storage capacitor 6 must therefore have a relatively large capacitance value Cs which is twice as great as that of the integration capacitor 5. It therefore requires a relatively large amount of space in an integrated circuit and thus increases the cost of the latter.

The SC-integrators embodying the invention which are described hereinafter operate in principle in a similar manner to the known SC-integrator. However they require a significantly lower capacitance value Cs for the storage capacitor 6 which can thus be produced compactly and less expensively in an integrated circuit, for example by means of CMOS-technology.

Figure 2:
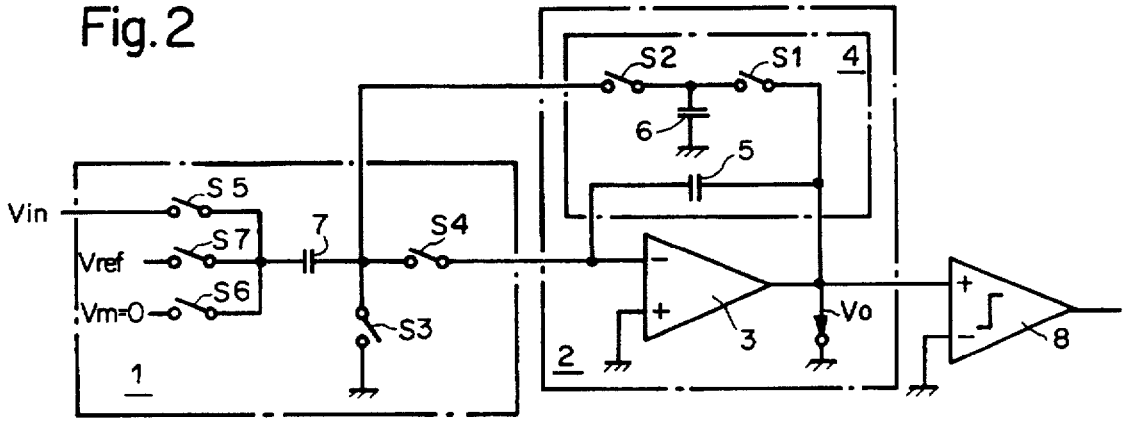
FIG. 2 shows a circuit diagram of a first variant of an SC-integrator embodying the invention.

The first variant of the SC-integrator embodying the invention as shown in FIG. 2, is of a similar configuration to the known SC-integrator shown in FIG. 1, with the difference that the second terminal of the storage capacitor 6 is connected directly to the first terminal of the circuit capacitor 7 by way of the second switch S2. In particular also the first variant provides the connection by way of the seventh switch S7 between the reference voltage Vref and the second terminal of the circuit capacitor 7 and the further voltage potential Vm is equal to the ground potential. In the first variant the sum Cf+Cs of a capacitance value Cf of the circuit capacitor 7 and a capacitance value Cs of the storage capacitor 6 is equal to double the capacitance value 2Ci of the integration capacitor 5. Therefore the following applies: $Cs = 2Ci - Cf$, that is to say in the first variant Cs is significantly smaller than the value 2Ci which is required in the known integrator. That results from the fact that the storage capacitor 6 is directly connected to the circuit capacitor 7 by way of the switch S2. Therefore at the moment of switching over, the voltage Vo across the integration capacitor 5, by way of the two closed switches S1 and S2, with the switch S4 open, charges the two capacitors 6 and 7 which are connected in parallel by means of the closed switches S2 and S6. Produced in them therefore during a first phase is a charge (Cs+Cf).Vo which in the next phase, with reversed polarity, is charged over into the integration capacitor 5 so that the total charge charged therein is equal to:

$$Ci \cdot Vo - (Cs + Cf) \cdot Vo = Vo \cdot (Ci - 2Ci) = -Vo \cdot Ci$$

when Cs+Cf=2Ci. The voltage across the integration capacitor 5 is thus reversed in polarity at the moment of switching over, and converted from +Vo into −Vo, which however this time requires a smaller storage capacitor Cs.

In the first variant each integration period comprises two time-staggered partial integration operations, wherein in the first the input voltage Vin is positively or negatively integrated and in the second it is the reference voltage Vref that is positively or negatively integrated. The number of partial integration operations per integration period can be reduced to one partial integration operation per integration period by means of the second or third variants described hereinafter, that is to say the input voltage Vin and the reference voltage Vref are simultaneously integrated so that the required speed of the amplifier 3 in those two variants is less than that in the first variant.

Figure 3:
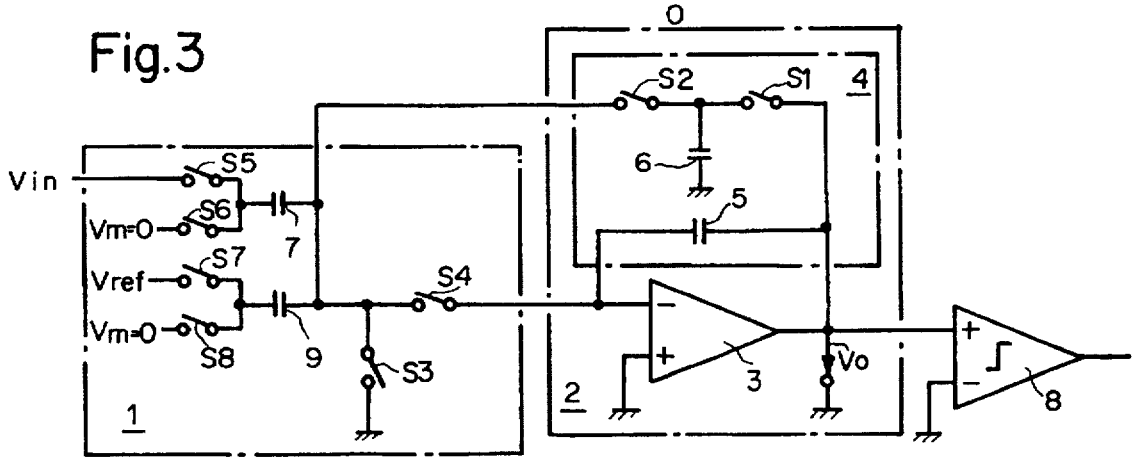
FIG. 3 shows a circuit diagram of a second variant of the SC-integrator embodying the invention.

The second variant of the SC-integrator embodying the invention, as illustrated in FIG. 3, is of a similar configuration to the first variant. In particular the further voltage potential Vm is again ground potential. The switch arrangement 1 however includes a further switch S8 and a further circuit capacitor 9. In this case the first terminals of the two circuit capacitors 7 and 9 are connected together and a second terminal of the further circuit capacitor 9 is connected to ground by way of the further switch S8. The connection by way of the seventh switch S7 is this time between the reference voltage Vref and the second terminal of the further circuit capacitor 9. The sum Cf+Cf1+Cs of capacitance values Cf and Cf1 of the two circuit capacitors 7 and 9 and the capacitance value Cs of the storage capacitor 6 is in the second variant equal to double the capacitance value 2Ci of the integration capacitor 5. Accordingly the second variant uses a respective separate circuit capacitor 7 and 9 for the input voltage Vin and for the reference voltage Vref. The capacitance values Cf and Cf1 of the two circuit capacitors 7 and 9 are preferably equal. In the second variant the three capacitors 6, 7 and 9 are connected in parallel when the switches S2, S6 and S8 are closed. At the moment of switching over, the voltage Vo across the integration capacitor 5, by way of the two closed switches S1 and S2, with the switch S4 open, charges the three capacitors 6, 7 and 9. In them therefore, during a first phase, there is a charge (Cs+Cf+Cf1)·Vo which in the next phase, with reversed polarity, is charged over into the integration capacitor 5 so that the total charge there is equal to:

$$Ci\cdot Vo-(Cs+Cf+Cf1)\cdot Vo=Vo\cdot(Ci-2Ci)=-Vo\cdot Ci$$

with Cs+Cf+Cf1=2Ci. The voltage across the integration capacitor 5 is thus reversed in polarity at the moment of switching over and converted from +Vo into −Vo, which this time requires a small storage capacitor Cs=2Ci−Cf−Cf1=2Ci−2Cf, with Cf=Cf1.

Figure 4:
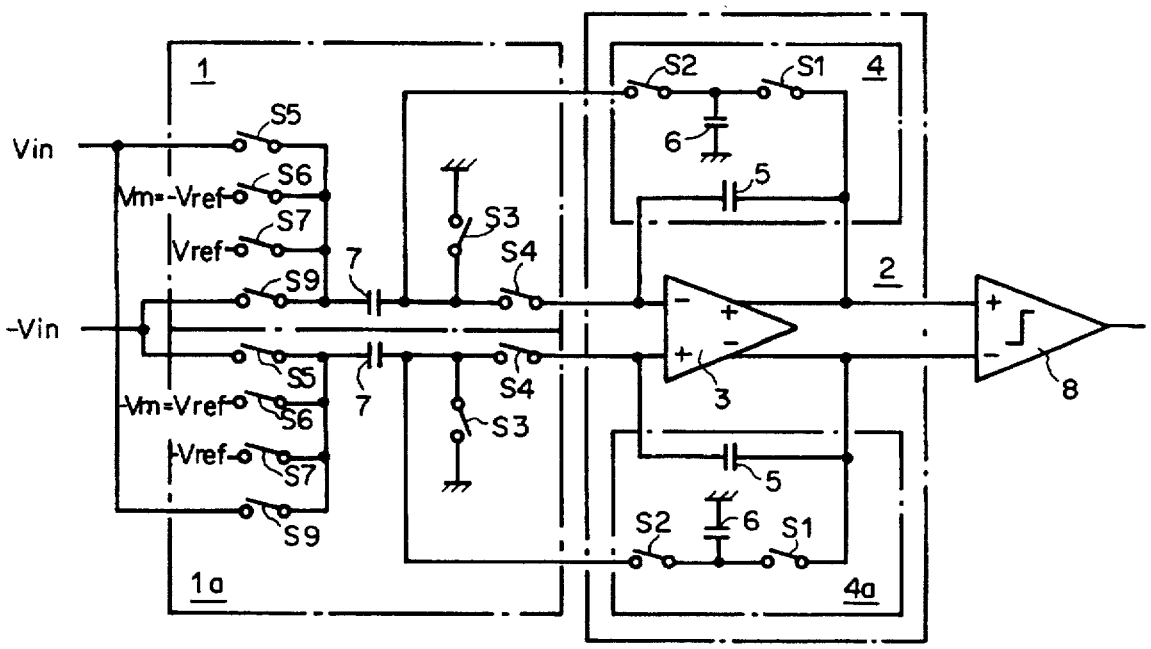
FIG. 4 shows a circuit diagram of a third variant of the SC-integrator embodying the invention.

The third variant of the SC-integrator embodying the invention, as shown in FIG. 4, is of a similar configuration to the first variant. In particular, in the first switch arrangement I the connection by way of the seventh switch S7 is again between the reference voltage Vref and the second terminal of the circuit capacitor 7.

In comparison with the first variant, the third variant differs as follows: the further voltage potential Vm is this time the reference voltage −Vref which is of reversed polarity. In addition, in the first switch arrangement 1 the second terminal of the circuit capacitor 7 is also additionally connected by means of a further switch S9 to the input voltage −Vin which is of reversed polarity. The amplifier 3 has a push-pull output and its non-inverting input is no longer at ground. In addition to the first circuit network 4 mentioned in the first variant and the first switch arrangement 1 mentioned therein, the amplifier 3 is also wired to a second circuit network 4*a* and a second switch arrangement 1*a* which are both connected to each other and to the amplifier 3 similarly to the way in which the first two are connected to each other and to the amplifier 3, with the difference that the inverting input of the amplifier 3 is replaced by its non-inverting input and the non-inverting output of the amplifier 3 is replaced by its inverting output. The two circuit networks 4 and 4*a* and the two switch arrangements 1 and 1*a* are each of respective identical configuration. The switches S1 to S7 and S9 are respectively so actuated in the two circuit networks 4 and 4*a* and in the two switch arrangements 1 and 1*a* respectively that switches identified by the same designations are simultaneously switched in operation of the assembly. The voltages Vin, −Vref, Vref and −Vin, and −Vin, Vref, −Vref and Vin respectively, which are connected to switches S5, S6, S7 and S9 identified by the same designations, that is to say by the same numbers, are of the same size and of reversed polarity in the two switch arrangements 1 and 1*a*. The inverting output of the amplifier 3 is connected to the inverting input of the comparator 8, which input is therefore no longer at ground. The sum Cf+Cs of the capacitance values Cf and Cs of the circuit capacitor 7 of the first and second switch arrangements 1 and 1*a* respectively and the storage capacitor 6 of the first and second circuit networks 4 and 4*a* respectively is in each case equal to double the capacitance value 2Ci of the integration capacitor 5 of the relevant first or second circuit network 4 and 4*a* respectively. The integrator of the third variant operates as a differential integrator with differential input and reference voltages, which permits simultaneous integration of those two voltages. Otherwise the equation Cs+Cf=2Ci of the first variant again applies. In a similar manner the second variant shown in FIG. 3 may also be designed as a differential assembly.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

We claim:

1. An SC-integrator with reversible polarity, said integrator comprising at least a first switch arrangement and an integration arrangement;

wherein said integration arrangement comprises an amplifier having an inverting input and a non-inverting output Vo, and at least a first circuit network to which said amplifier is connected, said first circuit network comprising an integration capacitor $C_i$, a storage capacitor $C_s$ having first and second terminals, and first and second switches, said non-inverting output Vo of said amplifier being connected via said integration capacitor $C_i$ to said inverting input of said amplifier, said first terminal of said storage capacitor $C_s$ being connected to ground and said second terminal of said storage capacitor $C_s$ being connected on the one hand to said non-inverting output Vo of said amplifier via said first switch, and on the other hand to said first switch arrangement via said second switch;

wherein said first switch arrangement comprises a circuit capacitor $C_f$ having first and second terminals, and third, fourth, fifth, sixth and seventh switches, said first terminal of said circuit capacitor $C_f$ being connected to ground via said third switch and connected via said fourth switch to said inverting input of said amplifier, said second terminal of said circuit capacitor $C_f$ being connected via said fifth switch to an input voltage Vin and via said sixth switch to a further voltage potential Vm, and said first switch arrangement being connected via said seventh switch to a reference voltage Vref; and wherein said second terminal of said storage capacitor $C_s$ is connected directly to said first terminal of said circuit capacitor $C_f$ via said second switch, such that the polarity of the voltage across said integration capacitor $C_i$ is reversed by the action of said storage capacitor $C_s$ connected in parallel with said circuit capacitor $C_f$.

2. An SC-integrator according to claim 1 in which said seventh switch is connected to said second terminal of said circuit capacitor $C_f$ for connection of said first switch arrangement to said reference voltage Vref, and in which said further voltage potential Vm is a ground potential, wherein the sum of the capacitance values of said circuit capacitor $C_f$ and said storage capacitor $C_s$ is equal to double the capacitance value of said integration capacitor $C_i$, such that $C_s+C_f=2*C_i$.

3. An SC-integrator according to claim 1 in which said further voltage potential Vm is a ground potential, and said first switch arrangement further comprises an eighth switch and an additional circuit capacitor $C_{f1}$ having first and second terminals, wherein the first terminals of said circuit capacitor $C_f$ and said additional circuit capacitor $C_{f1}$ are connected to each other, and said second terminal of said additional circuit capacitor $C_{f1}$ is connected via said eighth switch to ground, wherein said seventh switch is connected to said second terminal of said additional circuit capacitor $C_{f1}$ for connection of said first switch arrangement to said reference voltage Vref, and wherein the sum of the capacitance values of said circuit capacitors $C_f$ and $C_{f1}$ and of said storage capacitor $C_s$ is equal to double the capacitance value of said integration capacitor $C_i$, such that $C_s+C_f+C_{f1}=2*C_i$.

4. An SC-integrator according to claim 3 wherein the capacitance values of said circuit capacitors $C_f$ and $C_{f1}$ are the same.

5. An SC-integrator according to claim 1 wherein said amplifier has a push-pull output, and said amplifier is further connected to a second circuit network and a second switch arrangement which are connected to each other and to said amplifier in a similar manner to that in which said first circuit network and said first switch arrangement are connected to each other and to said amplifier, with the difference that the inverting input of said amplifier is replaced by the non-inverting input thereof, and the non-inverting output of said amplifier is replaced by the inverting output thereof.

6. An SC-integrator according to claim 5 in which, in said first switch arrangement, said seventh switch is connected to said second terminal of said circuit capacitor $C_f$ for connection of said first switch arrangement to said reference voltage Vref;

wherein said first and second circuit networks and said first and second switch arrangements are each of respectively identical configuration;

wherein, in said first switch arrangement, said further voltage potential Vm is said reference voltage provided with reversed polarity −Vref, and said second terminal of said circuit capacitor $C_f$ is further connected by means of a ninth switch to the reversed-polarity input voltage −Vin;

wherein the first to seventh switches and said ninth switch in the two circuit networks and the two switch arrangements are respectively so actuated that corresponding switches are simultaneously switched in operation;

wherein the voltages Vin, −Vref, Vref, and −Vin, and the voltages −Vin, Vref, −Vref, and Vin, which are connected to the fifth, sixth, seventh and ninth switches, respectively, in the first and second switch arrangements, are of the same magnitude and reversed polarity for corresponding switches in the two switch arrangements; and wherein the sum of the capacitance value of said circuit capacitor $C_f$ and the capacitance value of said storage capacitor $C_s$ is equal to double the capacitance value of said integration capacitor $C_i$.

* * * * *